US005367320A

United States Patent [19]

Taniguchi et al.

[11] Patent Number: 5,367,320

[45] Date of Patent: Nov. 22, 1994

[54] THERMAL HEAD AND SYSTEM INCLUDING THE SAME

[75] Inventors: Hideo Taniguchi; Hiroaki Onishi, both of Kyoto, Japan

[73] Assignee: Rohm Co., Ltd., Kyoto, Japan

[21] Appl. No.: 824,949

[22] Filed: Jan. 24, 1992

[30] Foreign Application Priority Data

| | | | |
|---|---|---|---|
| Jan. 30, 1991 | [JP] | Japan | 3-031581 |
| Jan. 30, 1991 | [JP] | Japan | 3-031582 |
| Jan. 31, 1991 | [JP] | Japan | 3-032312 |
| Jan. 31, 1991 | [JP] | Japan | 3-032313 |

[51] Int. Cl.[5] ..... B41J 2/335

[52] U.S. Cl. ..... 346/76 PH; 29/611

[58] Field of Search ..... 346/76 PH; 29/611

[56] References Cited

U.S. PATENT DOCUMENTS

| | | | |
|---|---|---|---|
| 4,944,983 | 7/1990 | Nonoyama et al. | 346/76 PH |
| 4,968,996 | 11/1990 | Ebihara et al. | 346/76 PH |
| 5,014,135 | 5/1991 | Ijuin et al. | 346/76 PH |
| 5,077,564 | 12/1991 | Thomas | 346/76 PH |
| 5,099,257 | 3/1992 | Nakazawa et al. | 346/76 PH |

FOREIGN PATENT DOCUMENTS

| | | |
|---|---|---|
| 0395001 | 10/1990 | European Pat. Off. . |
| 63-49451 | 3/1988 | Japan . |
| 63-252756 | 10/1988 | Japan . |

OTHER PUBLICATIONS

Patent Abstracts of Japan, vol. 11, No. 330 (M-636)(2777) 28 Oct. 1987 & JP-A-62 11 764 (Alps Electric) 22 May 1987 *abstract*.

Patent Abstracts of Japan, vol. 12, No. 343 (M-741)(3190) 14 Sep. 1988 & JP-A-63 104 851 (Hitachi) 10 May 1988 *abstract*.

Patent Abstracts of japan, vol. 14, No. 10 (M-917)(3953) 10 Jan. 1990 & JP-A-1 257 064 (Seiko) 13 Oct. 1989 *abstract*.

Patent Abstracts of Japan, vol. 11, No. 120 (M-580)(2567) 15 Apr. 1987 & JP-A-61 262 144 (Alps Electric) 20 Nov. *abstract*.

Patent Abstracts of Japan, vol. 11, No. 330 (M-636)(2777) 28 Oct. 1987 & JP-A-62 111 765 (Mitsubishi) 22 May 1987 *abstract*.

*Primary Examiner*—Benjamin R. Fuller
*Assistant Examiner*—Huan Tran
*Attorney, Agent, or Firm*—Oliff & Berridge

[57] ABSTRACT

The present invention provides a thermal head including a substrate of alumina, a glaze layer formed on the substrate and patterning resistor and electrode layers on the glaze layer. The thermal head is of a whole glaze type in which a heating section is formed on the glaze layer at or adjacent to the edge portion thereof or of a partial glaze type in which a heating section is formed on the glaze layer at or adjacent to its partially cut edge portion. Thus, the thermal head can print more clearly.

33 Claims, 15 Drawing Sheets

THERMAL HEAD AND SYSTEM INCLUDING THE SAME

BACKGROUND OF THE INVENTION

1. Field of the Invention

The present invention relates to a thermal printer head with an improved efficiency.

2. Description of the Related Art

Thermal heads are classified into partial-glaze type, double-partial-glaze type and through-edge type. As shown in FIG. 27, the partial-glaze type thermal head comprises a substrate 1, a partial glaze layer 2 formed on the substrate adjacent to its edge portion, having a width equal to about 300μ–1200μ and an outwardly convex configuration, a resistive film layer 3 formed over the partial glaze layer 2, common and individual electrodes 5 and 6 formed on the resistive film layer 3 at the top positions of the glaze layer 2 opposite to each other to form a heating section 4 on the top of the glaze layer 2 and a protecting film 7 covering these layers as a whole. The double-partial-glaze type thermal head is similar to the partial-glaze type thermal head except that a portion of the glaze layer 2 placed at the heating section 4 is formed into an upwardly convex configuration by glaze etching or the like, as shown by 2a in FIG. 28.

The through-edge type thermal head is one that has the glaze layer 2 and the heating section 4 formed so as to cover the edge of the substrate 1, as shown in FIG. 29. FIG. 30 shows a modification of the thermal head shown in FIG. 29, in which the edge portion of the substrate 1 is slantingly cut to provide a slope $1_B$ adjoining the top face $1_A$ of the substrate 1 and an edge face $1_C$ adjoining the slope $1_B$ and extending perpendicular to the top Face $1_A$. Glaze layers $2_A$, $2_B$ and $2_C$ are formed over the respective faces $1_A$, $1_B$ and $1_C$. The heating section 4 is formed at the slope $1_B$.

In order to enable the printing of any rough sheet and to improve the efficiency of the thermal head, it is necessary to focus pressure onto the ink ribbon, transfer sheet and platen at the heating section. In the partial-glaze and double-partial-glaze type thermal heads, however, the engagement of the glaze layer 2 with the rubber platen 10 through the ink ribbon 8 and transfer sheet 9 at the heating section 4 will be widened and so not provide a sufficient concentration of pressure at the heating section 4, as seen from FIG. 31. Such a problem can be somewhat overcome by the through-edge type thermal head. At present, however, the through-edge type thermal head of FIG. 29 must include a substrate having a thickness equal to about 2 mm, so that the inherent advantages of the through-edge type thermal head will not be fully attained.

Being common to the production of the conventional thermal heads, a substrate for each individual thermal head must be machined at its side edge before film formation and patterning are performed. Thus, a number of thermal heads cannot be produced from a single large-sized substrate. When it is desired to provide a thermal head in which the efficiency is improved by focusing pressure onto the heating section, the production becomes troublesome and expensive, leading to an increase in the cost for one thermal head.

SUMMARY OF THE INVENTION

It is therefore a primary object of the present invention to provide a thermal head which can be inexpensively produced with an increased concentration of pressure at the heating section and thus with an improved printing efficiency.

Another object of the present invention is to provide a thermal head which is improved in efficiency and can be excellently separated from the ink ribbon.

Still another object of the present invention is to provide a thermal head which is improved in efficiency and where the patterning process is simplified.

A further object of the present invention is to provide a method of inexpensively producing a thermal head with an improved printing efficiency.

The present invention provides a thermal head which comprises a dielectric substrate, a glaze layer formed on the dielectric substrate, a resistive film layer formed on the glaze layer, common and individual electrodes formed on the resistive Film layer at positions spaced apart from each other by a desired gap to form a heating section at the gap and a protecting film layer formed over the heating section, common electrode and individual electrode, said heating section being positioned at the corner portion of said glaze layer.

In this thermal head, the heating section is formed so as to cover the top and side faces of the glaze layer and also to cover the corner portion which is an intersection between the top face of the glaze layer and the slope of the same. Therefore, pressure will not be unnecessarily dispersed to the portions of the glaze layer and substrate that are out of the heating section. The pressure will be fully focused onto the heating section during operation. The glaze substrate is half-cut such that the substrate will be moved directly to the subsequent step such as film formation or patterning without full division. Thus, thermal heads can be mass-produced with a reduction in the cost for one thermal head.

In accordance with the present invention, the glaze layer includes a slope portion having its thickness gradually decreased toward the edge thereof, the heating section being located at the slope portion.

Since most of the heating section in the thermal head is formed at the slope portion, the distance between the heating section and the side edge face of the substrate is smaller which improves the separation of the ink ribbon from the heating section.

The heating section of the thermal head may be formed on the resistive film layer at a position offset from the corner portion of the glaze layer toward the center of the substrate.

Since most of the heating section is formed on the top face of the glaze layer, a pattern portion to be formed on the side face of the glaze layer is reduced to correspondingly promote the patterning even if the corner portion is formed at right angle.

The present invention also provides a method of producing a thermal head, which comprises the steps of forming a glaze layer on the top of a dielectric substrate, forming half-cut grooves on the substrate through the glaze layer, said half-cut grooves extending to divide the substrate into a plurality of thermal heads, subjecting the substrate with the glaze layer to heat treatment to form a rounded corner portion between each of said grooves and the top face of said glaze layer, forming and patterning a resistive film layer and an electrode conductor on the top face of said glaze layer and also the side face of each groove to form a heating section on said corner portion, forming a protecting film over said resistive film layer, electrode conductor and heating portion, and cutting all the grooves to provide a plurality of thermal heads.

In accordance with the method of the present invention, a plurality of thermal heads each of which can focus pressure onto the heating section to improve the efficiency on printing can be produced simultaneously by forming non-through half-cut grooves used to divide the substrate into a plurality of thermal heads and film-forming and patterning a heating section onto each of the side edge corner portions formed by these grooves. The rounded corner portion serves to eliminate any creation of burr and/or cutout. Thus, the film forming and patterning steps may be easily made against the smoothed face of the thermal head and so form the heating section into a stable configuration.

In accordance with the method of the present invention, the grooves used to provide a plurality of thermal heads may be formed on the dielectric substrate to extend downwardly through the glaze layer and to have a rectangular or substantially rectangular cross-section. The side edge of the glaze layer may be bulged outwardly at the top face of the glaze layer by heat treatment. A resistive film layer and electrode conductor are then formed and patterned on the top and bulged side edge faces of the glaze layer to form a heating section on the bulged edge portion. A protecting film is then formed over the resistive film layer, electrode conductor and heating section. Finally, the grooves are cut to provide a plurality of thermal heads.

In accordance with the method of the present invention, a plurality of thermal heads each of which can focus pressure onto the heating section to improve the efficiency on printing can produced simultaneously by forming non-through half-cut grooves each having a rectangular cross-section used to divide the substrate into a plurality of thermal heads, forming a bulged edge portion on the glaze layer at the corresponding groove by surface heat treatment and film-forming and patterning a heating section on the bulged edge portion. The rounded corner portion serves to eliminate any creation of burr and/or cutout. Thus, the film forming and patterning steps may be easily made against the smoothed face of the thermal head and form the heating section into a stable configuration.

These and other objects of the present invention will be more apparent from reading the following description of the present invention made with reference to the drawings in which similar or same parts will be denoted by similar or same reference numerals. Each figure in the drawings makes up part of the present invention.

DETAILED DESCRIPTION OF THE PREFERRED EMBODIMENTS

Figure 1:
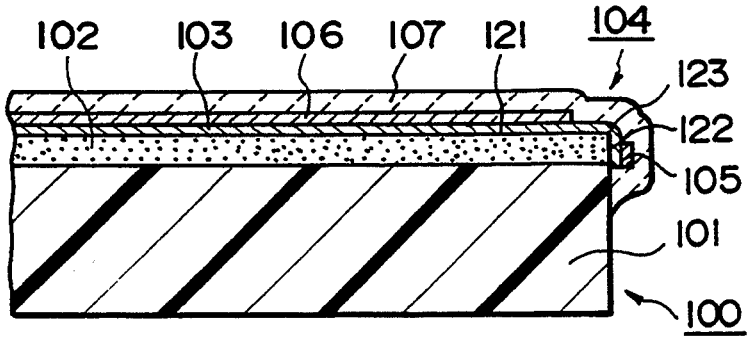
FIG. 1 is an enlarged cross-sectional view of the primary part of the first embodiment of a thermal head constructed in accordance with the present invention.

FIG. 1 shows a cross-sectional view of the primary part of the first embodiment of a thermal head 100 constructed in accordance with the present invention. The thermal head 100 comprises a substrate 101, an under glaze layer 102 formed on the top face of the substrate 101, a resistive film layer 103 formed on the under glaze layer 102, common and individual electrodes 105,106 formed on the resistive layer 103 and a protecting film 107 formed so as to cover all the layers and electrodes.

In the thermal head 100, heat is generated at a portion of the resistive film layer 103 on which the electrodes 105 and 106 are not formed. Thus, a portion of the protecting film 107 covering the heat generating portion of the resistive film layer 103 defines a heating section 104 to which an ink ribbon or heat-sensitive sheet is applied in order to perform the printing.

The thermal head 100 is characterized by the fact that it comprises the heating section 104 located on a corner portion 123. Such a corner portion 123 is defined by an intersection between the top face 121 and the side face 122 in the glaze layer 102. More particularly, the resistive film layer 103 is formed from the top glaze face 121 to the side glaze face 122 while at the same time the heating section 104 is formed on the corner portion 123. The common electrode 105 is located on the side glaze face 122 while the individual electrode 106 is disposed on the top glaze face 121. Thus, the printing will be made at the heating section 104 which is formed on the corner portion 123.

Figure 2:
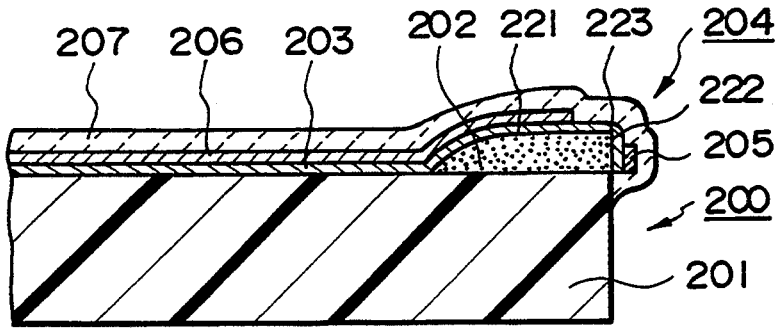
FIG. 2 is an enlarged cross-sectional view of the primary part of the second embodiment of a thermal head constructed in accordance with the present invention.

FIG. 2 shows a thermal head 200 which is the second embodiment of the present invention. The thermal head 200 includes a partial glaze 202 rather than the under glaze layer 102 in the thermal head of the first embodiment. Since the thermal head 200 has the partial glaze 202, a portion of a resistive film layer 203 is placed directly onto the substrate 201. Thus, the thickness of the partial glaze 202 in the thermal head 200 gradually decreases toward the edge portion of the substrate 201. Similarly, the thermal head 200 comprises a heating section 204 which is formed at a corner portion 223 defined by an intersection between the top glaze face 221 and the side glaze face 222. A common electrode 205 is formed on the side glaze face 222 while an individual electrode 206 is formed on the top glaze face 221.

Since the heating section is formed on the glaze layer corner portion extending perpendicular or substantially perpendicular to the top face of the substrate in each of the thermal heads 100 and 200 shown in FIGS. 1 and 2, the thermal head 100 or 200 can focus pressure onto the heating section when the thermal head is pressed against a platen through a heat-sensitive paper sheet.

Figure 3:
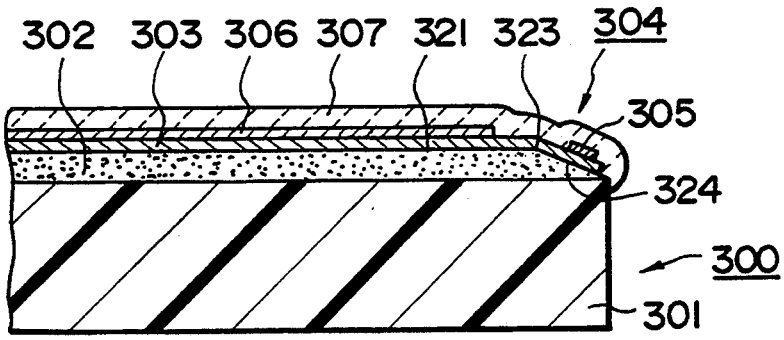
FIG. 3 is an enlarged cross-sectional view of the primary part of the third embodiment of a thermal head constructed in accordance with the present invention.

FIG. 3 shows a cross-sectional view of the third embodiment of a thermal head 300 constructed in accordance with the present invention. The thermal head 300 comprises an under glaze layer 302 which includes a top face 321, a slope face 324 formed in the under glaze layer 302 by slantingly cutting the edge portion thereof, and a corner portion 323 defined by an intersection between the top glaze face 321 and the slope face 324. In order to form a heating section 304, a common electrode 305 is disposed on the slope glaze face 324 while an individual electrode 306 is located on the top glaze face 321. Although the thermal head 100 of FIG. 1 has been described for the corner portion 123 of the glaze layer 102 to have its angle $\alpha$ equal to 90 degrees, the corner portion 323 of the thermal head 300 has an obtuse angle $\alpha$. By forming the slope glaze face 324 in such a manner, the width of pattern in the common electrode 305 can be made larger than that of the side glaze face 322 shown in FIG. 1. Therefore, the common electrode 305 may be patterned more easily.

Figure 4:
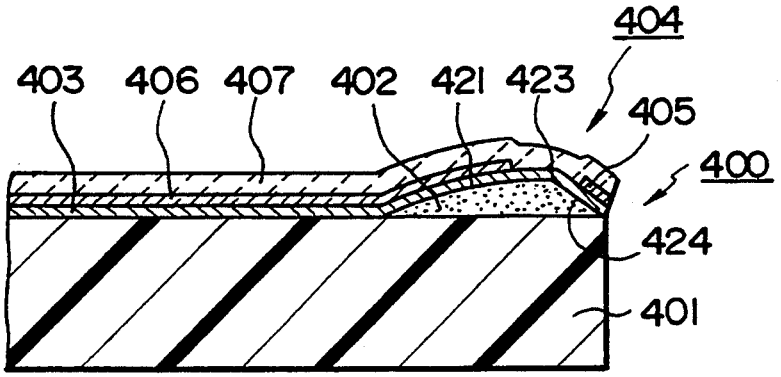
FIG. 4 is an enlarged cross-sectional view of the primary part of the fourth embodiment of a thermal head constructed in accordance with the present invention.

FIG. 4 shows a cross-sectional view of the primary part of the fourth embodiment of a thermal head 400 constructed in accordance with the present invention. The thermal head 400 comprises a partial glaze layer 402 as in the thermal head 200 of FIG. 2 and a slope glaze face 424 formed by slantingy cutting the partial glaze layer 402 at its edge. The thermal head 400 also includes a corner portion 423 defined by an intersection between the top glaze face 421 and the slope glaze face 424 in the partial glaze layer 402. A heating section 404 is formed on the corner portion 423. In such an arrangement, the width of pattern in the common electrode 405 can be made larger than that of the second embodiment. Consequently, the common electrode 405 can be patterned more easily.

Figure 5:
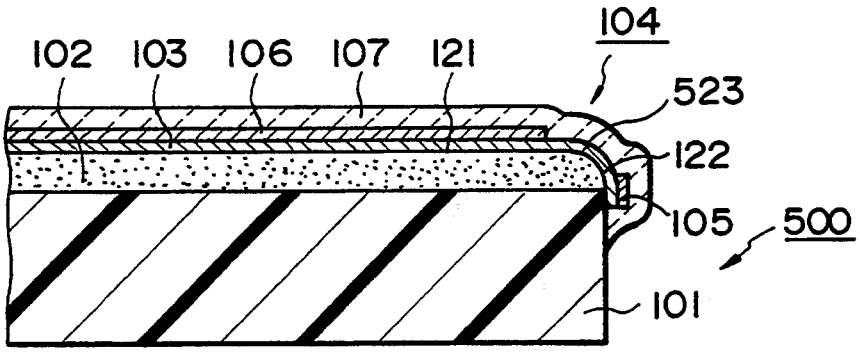
FIG. 5 is an enlarged cross-sectional view of the primary part of the fifth embodiment of a thermal head constructed in accordance with the present invention.
Figure 6:
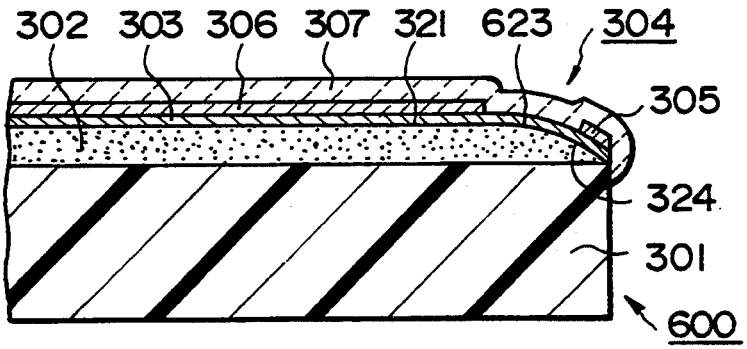
FIG. 6 is an enlarged cross-sectional view of the primary part of the sixth embodiment of a thermal head constructed in accordance with the present invention.

FIGS. 5 and 6 respectively show cross-sectional views of the primary parts of the fifth and sixth embodiments of a thermal head constructed in accordance with the present invention. The thermal head of the fifth embodiment is substantially the same as that of the first embodiment while the thermal head of the sixth embodiment is substantially the same as that of the third embodiment. However, each of the fifth and sixth embodiments is different from the respective one of the first and third embodiments in that while the thermal head of each of the first and third embodiment has a sharply formed corner 123 or 323, the thermal head of each of the fifth and sixth embodiments has a rounded corner portion 523 or 623. Components similar to those of the first and third embodiments are designated by similar reference numerals and will not be further described. The rounded corner portions 523 and 623 serve to eliminate any creation of burr and/or cutout and to promote the patterning.

A method of producing a thermal head in accordance with the present invention will now be described in connection with the thermal head 600 constructed in accordance with the sixth embodiment of the present invention.

Figure 7:
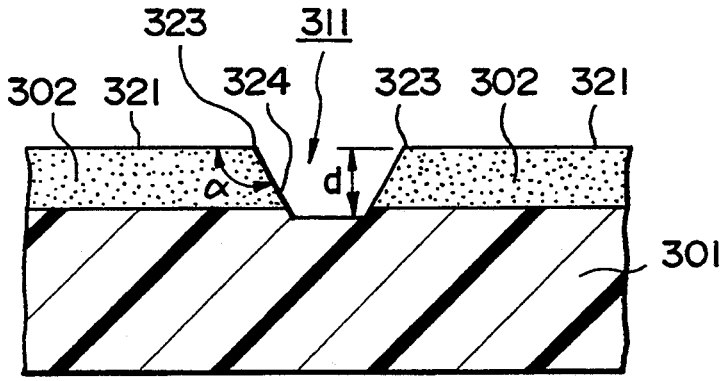
FIG. 7 is a view illustrating one step of a method for producing the thermal head of the sixth embodiment of the present invention.

A half-cut groove 311 having a depth d equal to or larger than the thickness of the glaze layer 302 is first formed on the ceramic substrate 301 on the top face of which the glaze layer 302 has been formed, as shown in FIG. 7. In the third and sixth embodiments, this groove 311 is formed such that a corner portion 323 will be formed in the glaze layer 302 at each top edge of the groove 311 with an obtuse angle $\alpha$. Thus, a slope face 324 is formed in the glaze layer 302 at each side wall of the groove 311. The depth d of the groove 311 may be equal to or smaller than the thickness of the glaze layer 302. This is true of the case when the glaze layer has a relatively large thickness or when the slope has a relatively large angle (obtuse angle). Being not illustrated, a plurality of such grooves 311 are actually formed on the substrate 301 having such a dimension that a plurality of thermal heads can be cut away therefrom.

Figure 8:
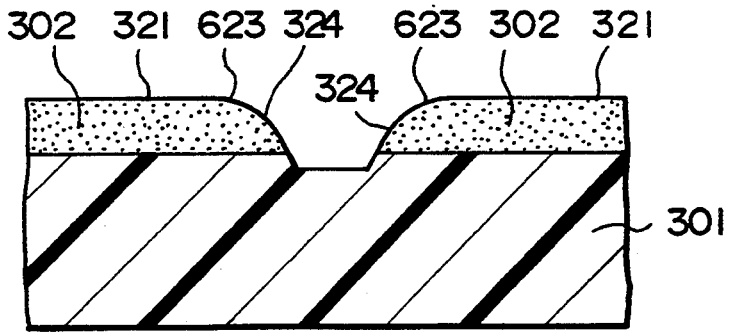
FIG. 8 is a view illustrating one step of a method for producing the thermal head of the sixth embodiment of the present invention.

When the substrate is machined to form the half-cut grooves, burrs and/or cutouts may be formed on the corner portions 623 of the glaze layer 302. Further, the surface smoothness is lowered. Therefore, the substrate 301 is subjected to heat treatment at 800° C.–1000° C., this range of temperature being suitable for the conventional glaze materials, but may exceed 1000° C. for a glass material having a higher softening point which will be developed in the future. Such a heat treatment rounds the corner portions 623 of the glaze layer 302 while improving the surface smoothness, as shown in FIG. 8. This facilitates the subsequent patterning operation.

Figure 9:
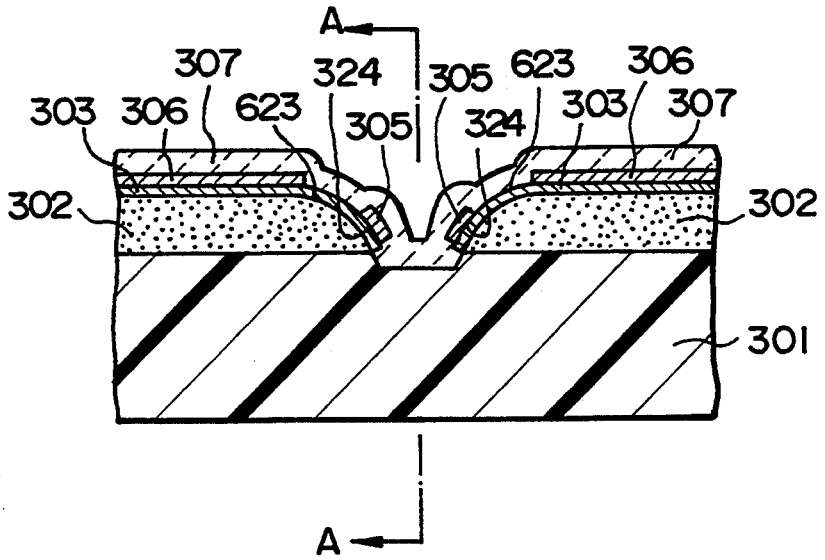
FIG. 9 is a view illustrating one step of a method for producing the thermal head of the sixth embodiment of the present invention.
Figure 10:
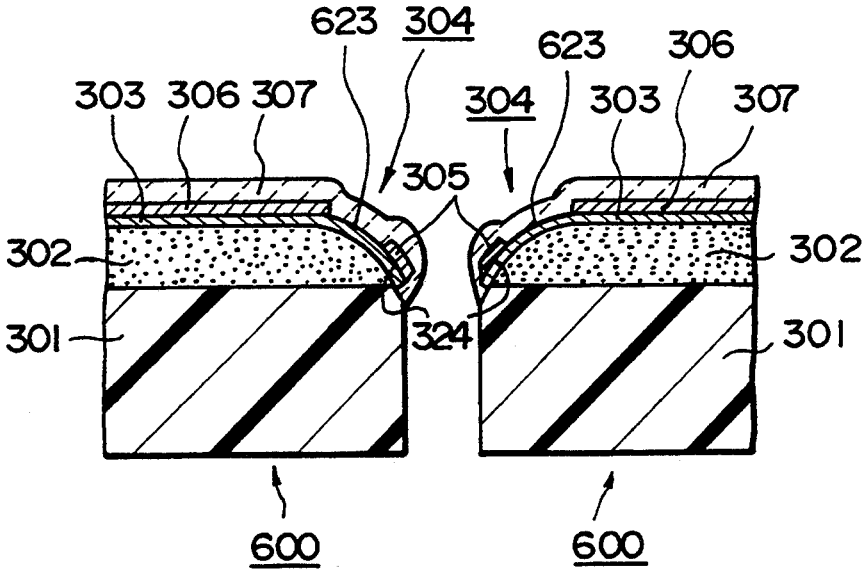
FIG. 10 is a view illustrating one step of a method for producing the thermal head of the sixth embodiment of the present invention.

After the heat treatment, the resistive film layer 303, common electrode 305 and individual electrodes 306 are formed and patterned by the well-known photolithographic technique. The protecting film 307 is then formed to provide the before-division substrate as shown in FIG. 9. Finally, the substrate is divided along a line A—A in FIG. 9 into a plurality of individual thermal heads 600 which are shown in FIG. 10. Consequently, one can obtain thermal heads constructed in accordance with the sixth embodiment of the present invention.

Since the glaze layer 302 is half-cut to provide the grooves and each of the corner portions 623 is formed with an obtuse angle, this method can produce a number of thermal heads simultaneously as in the conventional process of producing planar heads.

If the film formation and patterning are carried out without any heat treatment after the burrs and/or cutouts have been removed in the step of FIG. 7, such a thermal head as constructed in accordance with the third embodiment of FIG. 3 can be provided. If the film formation and patterning are performed without any heat treatment after the half-cut grooves 311 have been formed in the step of FIG. 7 to have a rectangular configuration rather than an inverse trapezoidal configuration, such a thermal head as constructed in accordance with the first embodiment shown in FIG. 1 can be provided. If the film formation and patterning are made after heat treatment with the grooves 311 having a rectangular configuration, such a thermal head as constructed in accordance with the fifth embodiment of FIG. 5 can be provided.

Although the method of the present invention has been described to provide a thermal head in which an under glaze layer 102 or 302 is formed on the top face of the substrate 301, it may be substantially similarly applied to produce a thermal head comprising a partial glaze 202 or 402 as shown in FIG. 2 or 4.

Thus, the present invention provides a thermal head in which pressure can be fully concentrated onto the heating section since the heating section is formed on the corner portion in the glaze layer. Such a thermal head can perform an improved thermal transfer of ink onto a rough sheet. The increased concentration of pressure can improve the printing efficiency with lower energy and without excessive accumulation of heat and accomplish a high-speed printing operation. The distance of ribbon separation, which will be described later, can be decreased in accordance with the present invention. This also contributes to an improvement of the printing efficiency.

Since the film formation and patterning are performed onto the substrate before division to form the heating sections on the corner portions by forming the non-through half-cut grooves and the rounded corner portions in the glaze layer, a plurality of inexpensive thermal heads each having an improved printing efficiency can be produced simultaneously.

Figure 11:
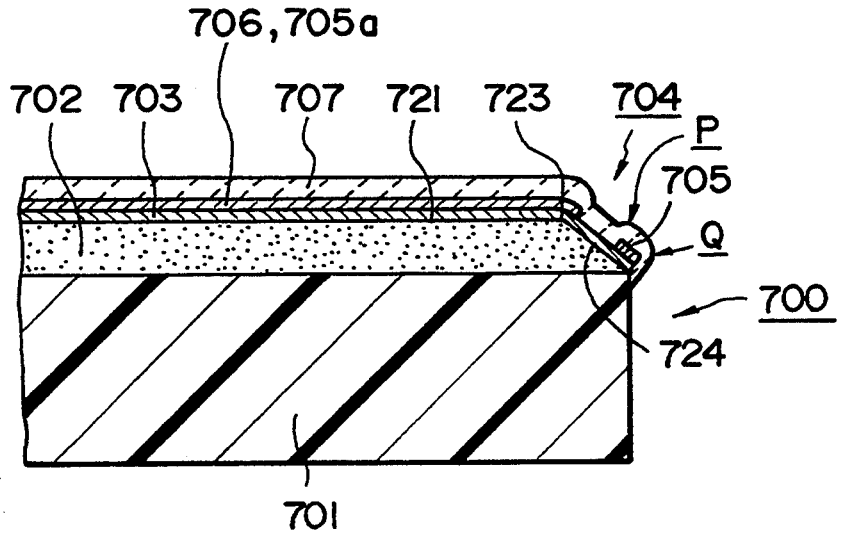
FIG. 11 is an enlarged cross-sectional view of the primary part of the seventh embodiment of a thermal head constructed in accordance with the present invention.

FIG. 11 shows a cross-sectional view of the primary part of a thermal head 700 constructed in accordance with the seventh embodiment of the present invention. The thermal head 700 comprises a substrate 701, an under glaze layer 702 formed on the top face of the substrate 701, a resistive film layer 703 formed on the glaze layer 702, common and individual electrodes 705 and 706 formed on the resistive film layer 703, and a protecting film 707 covering the resistive film layer 703 and electrodes 705, 706, all of these components defining a basic thermal head arrangement. This is not different from those of the first, third. fifth and sixth embodiments.

The thermal head 700 of the seventh embodiment is characterized by the fact that it comprises a slope glaze face 724 formed by slantingly cutting a glaze layer 702 at its edge, a glaze corner portion 723 defined by an intersection between the glaze face 721 and the slope glaze face 724, and a hearing section 704 formed on the slope glaze face 724 rather than the glaze corner portion 723. More particularly, a resistive film layer 703 is formed from the top glaze face 721 to the slope glaze face 724. A common electrode 705 is formed on the slope glaze face 721 at a position adjacent to the edge thereof while each individual electrode 706 is formed from the top glaze face 721 to the glaze corner portion 723. The heating section 704 is positioned at a location adjacent to the edge of the glaze layer, rather than the glaze corner portion 723.

Since the thermal head 700 of the seventh embodiment includes the heating section 704 formed on the slope glaze face 724 at a location adjacent to the edge of the glaze layer rather than the glaze corner portion 723, some degree of pressure can be concentrated onto the heating section 704 when the thermal head is pressed against a platen through a heat-sensitive sheet or ribbon. This means that the same pressure is applied to the heat-sensitive sheet or ribbon. Due to the fact that the heating section 704 is disposed on the substrate 701 adjacent to the edge thereof in addition to the application of pressure against the heat-sensitive sheet or ribbon, the separation of ribbon, which will be described later, can be improved to provide clear printed letters.

Figure 12:
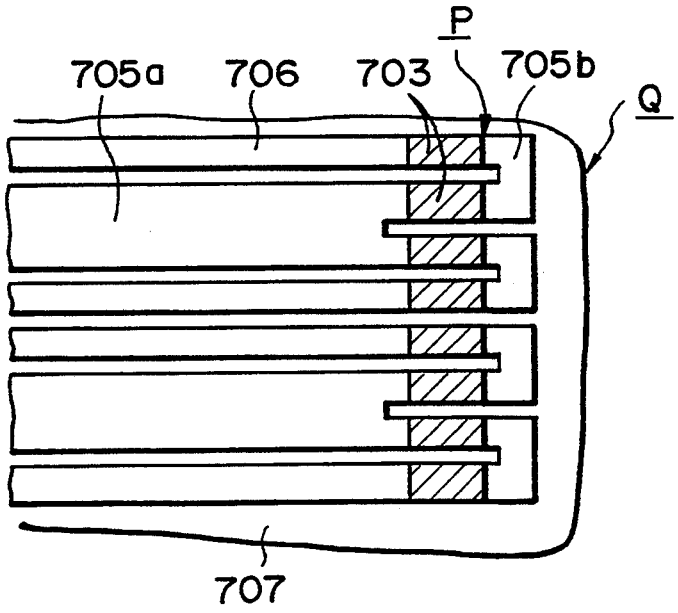
FIG. 12 is a view illustrating the patterns of electrode and resistive film in the thermal head which is the seventh embodiment of the present invention.
Figure 13:
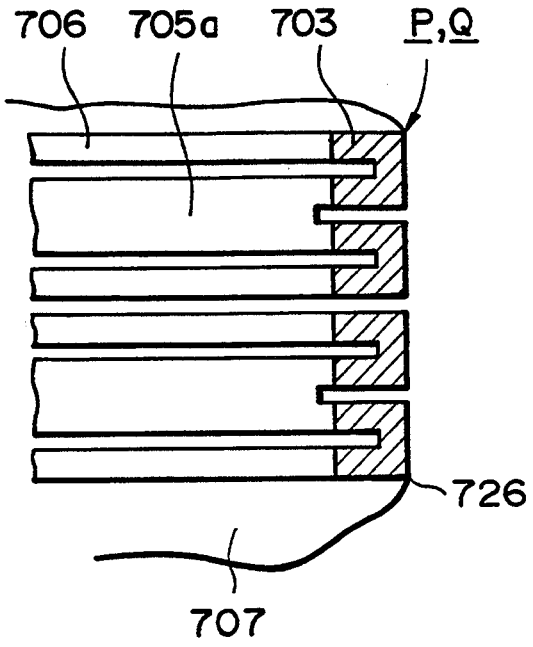
FIG. 13 is a view illustrating the patterns of electrode and resistive film in a modification of the seventh embodiment of the present invention.

FIG. 12 is a top plan view of the thermal head 700 constructed in accordance with the seventh embodiment of the present invention, illustrating a pattern in which the resistive film layer 703, common electrode 705 and individual electrode 706 are disposed on the thermal head 700.

As will be apparent from FIG. 12, the common electrode 705 includes a common electrode portion **705*a* and a common return electrode portion 705*b*. These electrode portions 705*a* and 705*b* co-operate with the individual electrode 706 to generate heat at the resistive film layer 703**.

In FIG. 11, the distance from the edge P of the heating section 704 to the edge Q of the thermal head is a distance of separation required to separate a printed sheet from an ink ribbon. As can be seen from FIG. 12, the edge P of the heating section is on the boundary between the resistive film layer 703 and the common return electrode 705*b* while the edge Q of the thermal head is on the edge of the protecting Film 707. When an ink ribbon is used as a heat transfer means, it will be pulled by a thermally printed sheet through the distance between the edges P and Q. Thus, this distance is called a distance of ribbon separation. As the distance of ribbon separation is increased, the printing is performed less clearly.

In the present heat transfer system, an ink ribbon has been currently utilized which contains an ink having an increased viscosity for enabling the ink ribbon to print on rough paper. This increases the distance of ribbon separation. If the viscosity of the ink in the ink ribbon is reduced to cause the ink to flow fully into the rough surface of the printing sheet, the ink will blot on the paper. By causing the ink to have some viscosity, the ink can be applied from the ink ribbon to the printing paper with a given pattern of letter under the pressure from the thermal head, as in the transfer paper. More particularly, a desired pattern of letter is thermally formed on the ink ribbon and then applied to the paper under the pressure from the thermal head. The thermal transfer of the ink onto the rough paper can be accomplished by causing the ink to have some viscosity and then to separate from the rough paper on heating. Thus, the transfer and separation of the ink will be carried out simultaneously on heating. As the time interval between the transfer and the ration is decreased, the printing can be made more clearly. If such a time interval increases, it becomes difficult for the pattern of the letter to transfer and separate properly from the ink ribbon. This degrades the transfer of ink onto the paper. Furthermore, if time passes away after heating, the ink to be transferred will be cooled and hardened so that the ink or the formed pattern of letter will not be transferred to the paper, is therefore required that the distance between the edges P and Q, that is, the distance of ribbon separation is as small as possible.

Figure 14:
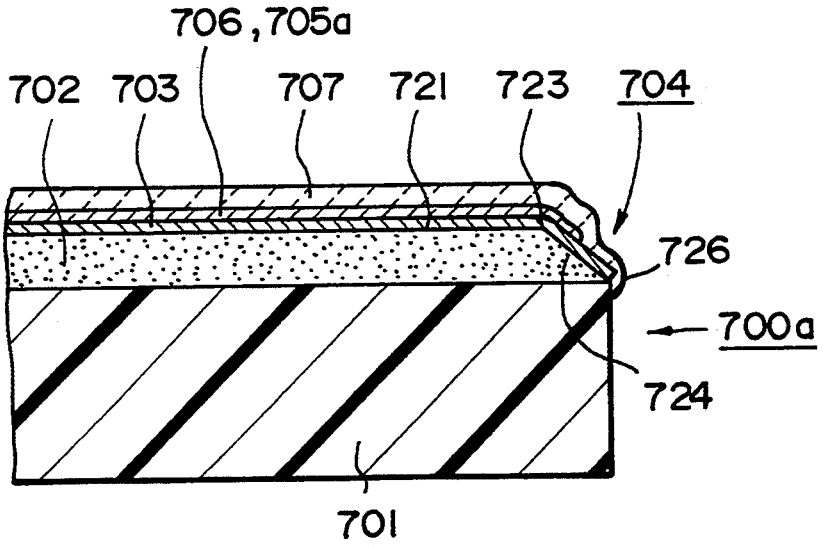
FIG. 14 is an enlarged cross-sectional view of the modification of the seventh embodiment of the present invention.

Referring to FIG. 14, there is shown a modification of the seventh embodiment in which the common return electrode 705*b* is omitted while retaining the common electrode 705*a*. Further, an edge portion 726 is formed to align the edge P of the heating section 704 with the edge Q of the thermal head 700 at the edge portion 726. Thus, the distance of ribbon separation becomes substantially zero. As a result, the ink ribbon can be separated more properly to improve the printing.

The thermal head of FIG. 14 can be produced in accordance with the following process.

Figure 15:
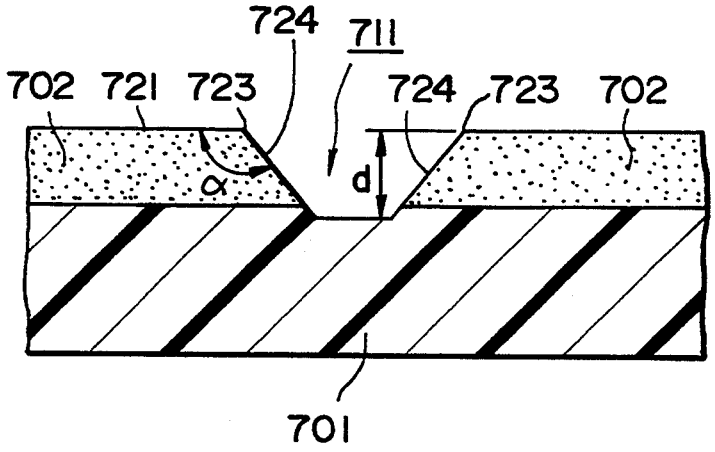
FIG. 15 is a view illustrating one step of a method for producing the thermal head of the seventh embodiment of the present invention.

As shown in FIG. 15, a half-cut groove 711 having a depth d equal to or larger than the thickness of the glaze layer 702 is first formed on the ceramic substrate 701 on the top face of which the glaze layer 702 has been formed. This groove 711 is formed into an inverse trapezoidal configuration such that a corner portion 723 will be formed in the glaze layer 702 at each top edge of the groove 711 with an obtuse angle $\alpha$. Thus, a slope face 724 is formed in the glaze layer 702 at each side wall of the groove 711. The depth d of the groove 711 may be equal to or smaller than the thickness of the glaze layer 702. This is true of the case when the glaze layer has a relatively large thickness or when the slope has a relatively large angle (obtuse angle). Being not illustrated, a plurality of such grooves 711 are actually formed on the substrate 701 having such a dimension that a plurality of thermal heads can be cut away therefrom.

Figure 16:
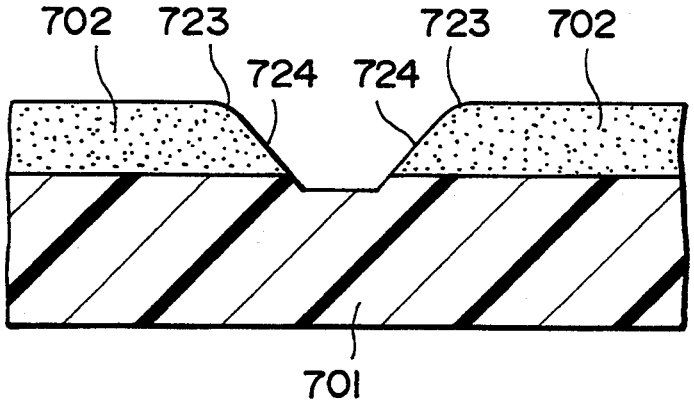
FIG. 16 is a view illustrating one step of a method for producing the thermal head of the seventh embodiment of the present invention.

When the substrate is machined to form the half-cut grooves, burrs and/or cutouts may be formed on the corner portions 723 of the glaze layer 702. Further, the surface smoothness is lowered. Therefore, the substrate 701 is subjected to heat treatment at 800° C.–1000° C. Such a heat treatment rounds the corner portions 723 of the glaze layer 702 while improving the surface smoothness, as shown in FIG. 16. This facilitates the subsequent patterning operation.

Figure 17:
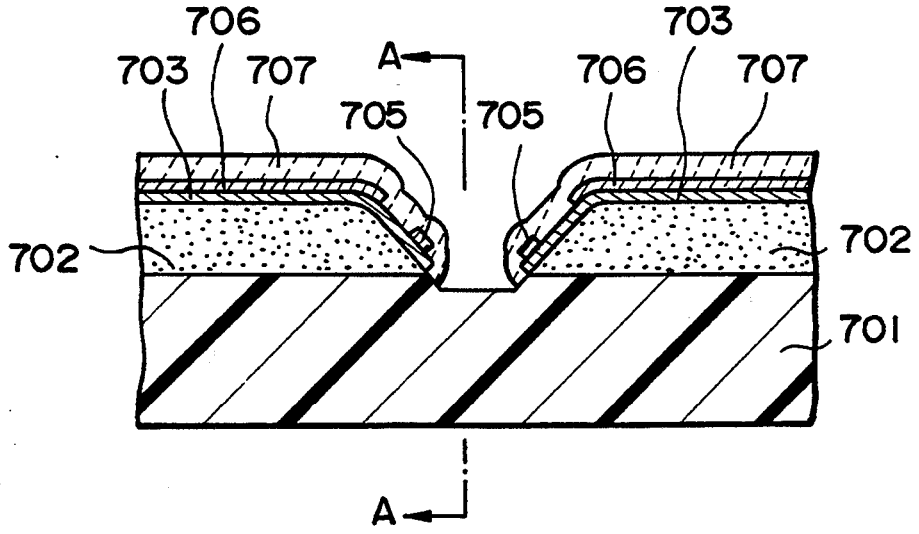
FIG. 17 is a view illustrating one step of a method for producing the thermal head of the seventh embodiment of the present invention.
Figure 18:
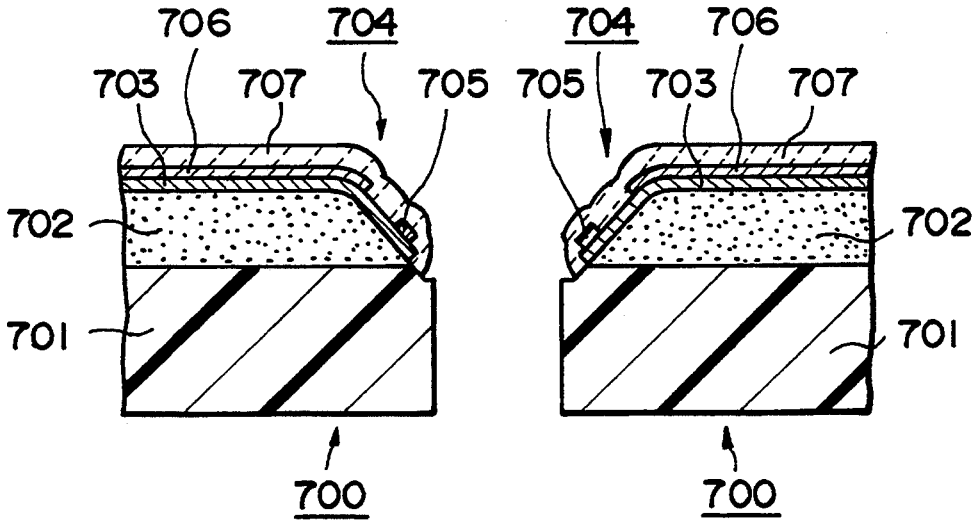
FIG. 18 is a view illustrating one step of a method for producing the thermal head of the seventh embodiment of the present invention.

After the heat treatment, the resistive film layer 703, common electrode 705 and individual electrodes 706 are formed and patterned by the well-known photolithographic technique. The protecting film 707 is then formed to provide the before-division substrate as shown in FIG. 17. Finally, the substrate is divided along a line A—A in FIG. 17 into a plurality of individual thermal heads 700 which are shown in FIG. 18. Consequently, one can obtain thermal heads constructed in accordance with the seventh embodiment of the present invention and also thermal heads 700*a* constructed in accordance with the modification of the seventh embodiment as shown in FIG. 14.

Since the glaze layer 702 is half-cut to provide the grooves and each of the corner portions 723 is formed with an obtuse angle, this method can produce a number of thermal heads simultaneously as in the conventional process of producing planar heads.

Figure 19:
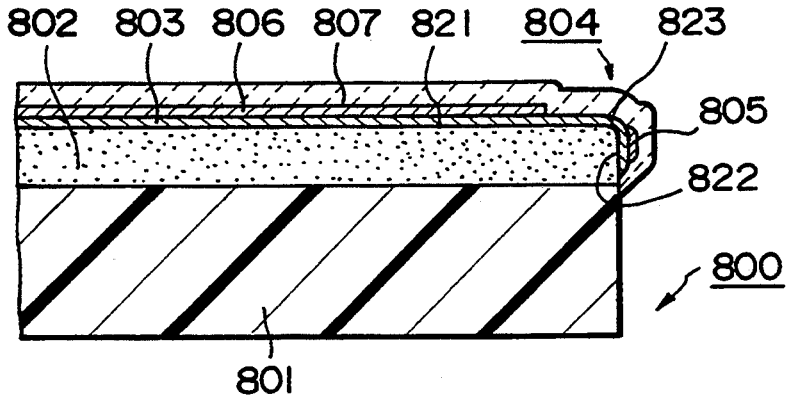
FIG. 19 is an enlarged cross-sectional view of the primary part of the eighth embodiment of a thermal head constructed in accordance with the present invention.

FIG. 19 shows a cross-sectional view of the primary part of a thermal head 800 which is the eighth embodiment of the present invention. The thermal head 800 has a basic arrangement which comprises a substrate 801, an under glaze layer 802 formed on the top face of the substrate 801, a resistive film layer 803 formed on the under glaze layer 802, common and individual electrodes 805,806 formed on the resistive film layer 803 and a protecting layer 807 formed to cover the resistive film layer 803 and electrodes 805, 806. This basic arrangement is not different from that of the thermal head 700 constructed in accordance with the seventh embodiment.

The thermal head 800 is characterized by the fact; that a heating section 822 is formed at a position offset toward the center of the substrate from a glaze corner portion 823 which is defined by an intersection between the top glaze face 821 and the side glaze face 822. In other words, the resistive film layer 803 is formed from the top glaze face 821 to the side glaze face 822. The common electrode 805 is formed on the upper portion of the side glaze face 822 while the individual electrode 806 is formed on the top glaze face 821 except the edge thereof. In such a manner, the heating section 804 is positioned at a position shifted from the corner portion 823 toward the center of the substrate.

Due to such a position of the heating section 804, the thermal head 800 can be properly pressed against the platen through a heat-sensitive sheet or ribbon while concentrating some pressure onto the heating section 804. As a result, the heating and pressing can be carried out simultaneously and effectively. In addition, the patterning can be more easily performed since most of the heating section 804 is formed on the top face 821 of the glaze layer 802 and the common electrode is formed adjacent to the upper edge of the side wall of the substrate.

By forming grooves 811 into a rectangular configuration, the thermal head 800 can be produced in accordance with the process described in connection with FIGS. 15–18.

If a slope is formed at the edge of the glaze layer and the heating section is formed on the slope at a position nearer to the edge of the substrate than the corner portion, the time required to extend the ink ribbon can be increased and also the angle required to separate the ink ribbon from the thermal head (angle of separation) can be increased. Thus, the thermal head of the present invention is very effective for the use of any ink ribbon type heat transfer means which would be highly influenced by the time and angle of separation.

The thermal head of the eighth embodiment facilitates the patterning since the heating section is formed on the top face of the glaze layer at a position offset from the corner portion of the glaze layer toward the center of the substrate.

Figure 20:
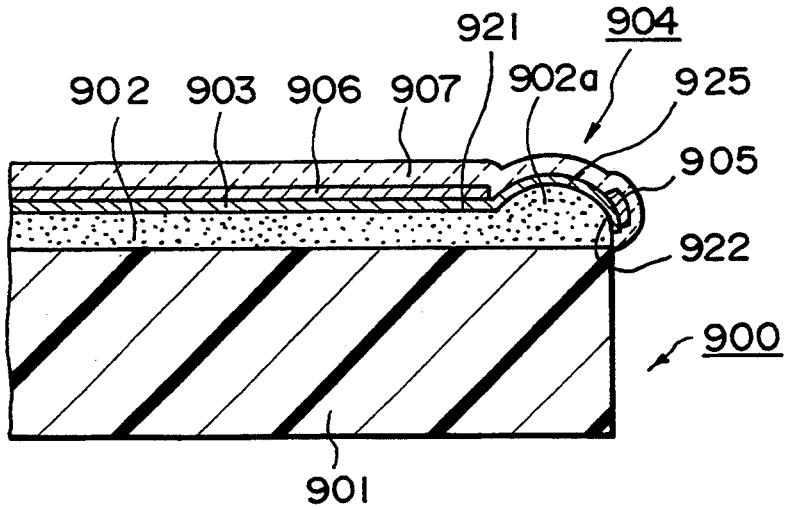
FIG. 20 is an enlarged cross-sectional view of the primary part of the ninth embodiment of a thermal head constructed in accordance with the present invention.

FIG. 20 shows a cross-sectional view of the primary part of a thermal head 900 constructed in accordance with the ninth embodiment of the present invention.

The thermal head 900 has a basic arrangement which comprises a ceramic substrate 901, an under glaze layer 902 formed on the top face of the substrate 901, a resistive film layer 903 formed on the under glaze layer 902, common and individual electrodes 905, 906 formed on the resistive film layer 903 and a protecting layer 907 formed so as to cover the resistive film layer 903 and electrodes 905, 906. This basic arrangement is not different from that of the thermal head 800 constructed in accordance with the eighth embodiment.

The thermal head 900 is characterized by the fact that the edge portion 902*a* of the glaze layer 902 outwardly extends to form a bulged portion 925 at the top edge of the glaze layer 902 which is defined by an intersection between the top glaze face 921 and the side glaze face 922. On the bulged portion 925 is formed a heating section 904 by forming the common electrode 905 on the side glaze face 922 and the individual electrode 906 on the top glaze face 921.

The thermal head 900 of the ninth embodiment can be produced in accordance with the following process.

Figure 21:
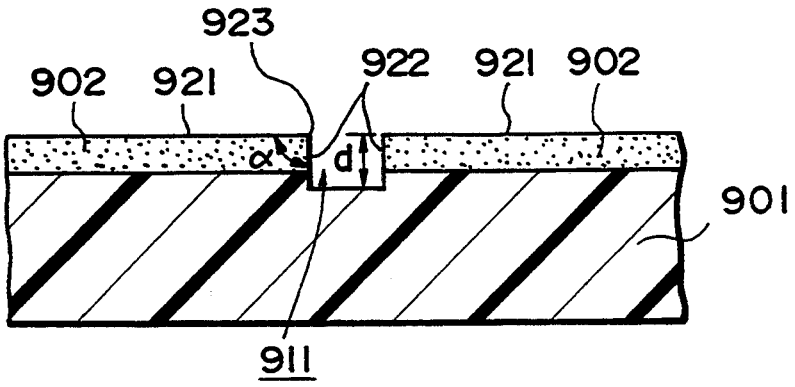
FIG. 21 is a view illustrating one step of a method for producing the thermal head of the ninth embodiment of the present invention.

As shown in FIG. 21, a half-cut groove 911 having a depth d equal to or larger than the thickness of the glaze layer 902 is first formed on the ceramic substrate 901 on the top face of which the glaze layer 902 has been formed. This groove 911 is formed into a rectangular configuration such that a corner portion 923 will be formed in the glaze layer 902 at each top edge of the groove 911 with an obtuse angle $\alpha$. Thus, a slope face 924 is formed in the glaze layer 902 at each side wall of the groove 911. The depth d of the groove 911 may be equal to or smaller than the thickness of the glaze layer 902. This is true of the case when the glaze layer has a relatively large thickness. Being not illustrated, a plurality of such grooves 911 are actually formed on the substrate 901 having such a dimension that a plurality of thermal heads can be cut away therefrom.

When the substrate is machined to form the half-cut grooves, burrs and/or cutouts may be formed on the corner portions 723 of the glaze layer 702. Further, the surface smoothness is lower. Therefore, the substrate 701 is subjected to heat treatment at 900° C.

Figure 22:
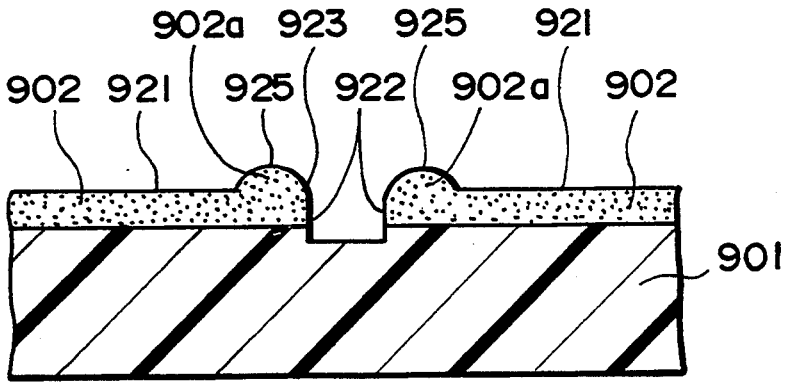
FIG. 22 is a view illustrating one step of a method for producing the thermal head of the ninth embodiment of the present invention.

When the entire substrate is thermally treated at a raised temperature equal to about 900° C., the glaze layer 902 on the substrate 901 will be heated up to a temperature exceeding its softening point at which the glaze layer 902 will have a flowability. Under such a flowable state, the temperature of the glaze layer 902 is slightly decreased to maintain the flowability at the desired level while retaining a desired viscosity. Under such a condition, further, only the surface of the glaze layer 902 is heated. As a result, the edge of the glaze layer 902 is bulged due to surface tension in the glaze layer 902 itself. This is the same phenomenon as in a large liquid drop which comprises a central recessed portion and a peripheral raised portion. The resulting bulged edge portion is a bulged portion 925 shown in FIG. 22. The bulged portion 925 performs an effective function in the ninth embodiment of the present invention. In the ninth embodiment, furthermore, the heat treatment provides a rounded corner portion and a smoother surface such that the subsequent patterning operation will be facilitated. If the entire substrate is gradually cooled after it has been heat treated at 900° C. with only the surface thereof being machined at a temperature slightly lower than 900° C., the bulged portion will have a curvature R equal to 100 and a height equal to 7$\mu$. Since the glaze layer 902 is gradually cooled, any strain will not be created in the amorphous glass. This provides a stable thermal head.

Figure 23:
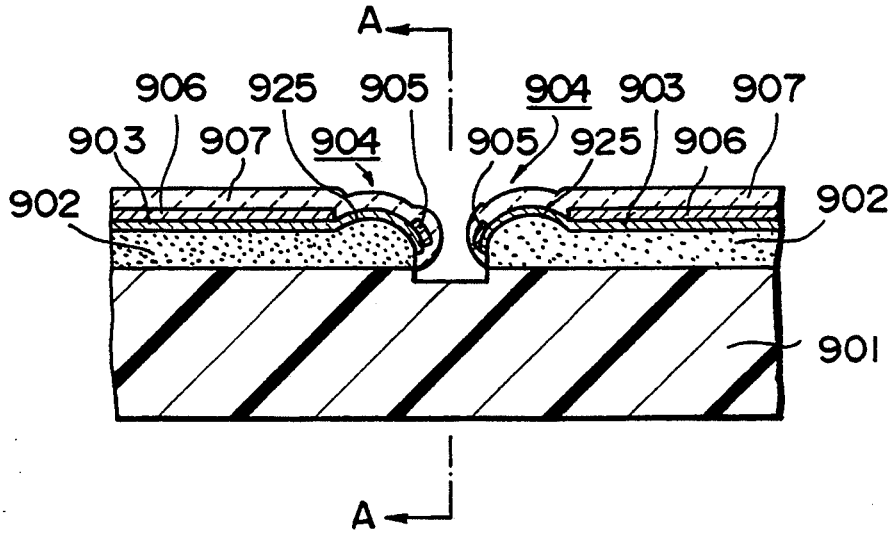
FIG. 23 is a view illustrating one step of a method for producing the thermal head of the ninth embodiment of the present invention.
Figure 24:
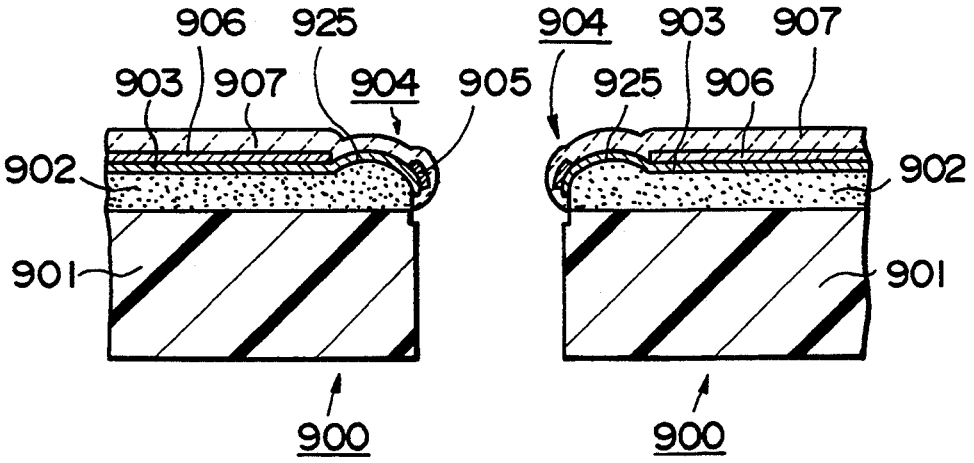
FIG. 24 is a view illustrating one step of a method for producing the thermal head of the ninth embodiment of the present invention.

After the heat treatment, the resistive film layer 903, common electrode 905 and individual electrodes 906 are formed and patterned by the well-known photolithographic technique. The protecting film 907 is then formed to provide the before-division substrate as shown in FIG. 23. Finally, the substrate is divided along a line A—A in FIG. 23 into a plurality of individual thermal heads 900 which are shown in FIG. 24. Consequently, it is possible to obtain thermal heads 900 constructed in accordance with the ninth embodiment of the present invention.

Since the process comprises the steps of forming half-cut grooves 911 of rectangular cross-section on the glaze layer 902 and the bulged portion 925 on each of the edges of the grooves, it is not different from the conventional process of making planer heads. Thus, a number of thermal heads can be easily produced simultaneously. Although the ninth embodiment has been described as to the rectangular configuration in the grooves, the half-cutting may be carried out with some angle to generate the bulged portion in the same manner. Although the ninth embodiment has also been described with reference to the substrate which is entirely coated with the glaze layer, the present invention may be applied similarly to a partial-glaze type substrate including a glaze layer having a size smaller than the entire surface area of the substrate.

Although the step of FIG. 8 has been described to round the edge of the glaze layer by heat treatment, this is because the angle $\alpha$ on half-cutting is obtuse rather than a right angle, unlike the ninth embodiment. In other words, if the above angle $\alpha$ is obtuse as shown in FIGS. 7 and 15, the edge of the glaze layer will be rounded by heat treatment. However, any bulged edge portion will not be normally formed. If there is any other factor such as the angle $\alpha$ very approximate to 90 degrees or the increased thickness of the glaze layer, a bulged edge portion can be formed as in the ninth embodiment. In such a case, the resulting thermal head may be used in the arrangement of the ninth embodiment, that is, as a thermal printer head including a bulged edge portion 925.

In the first through ninth embodiments, the size of the heating section is equal to about 100μ—about 200μ, with the pitch thereof being equal to about 60μ.

In accordance with the present invention, the half-cut grooves of rectangular or substantially rectangular cross-section are formed and the bulged portion is formed on the edge portion of the glaze layer by heat treatment. Since the heating section is formed and patterned on the bulged portion before cutting the substrate, a number of inexpensive thermal heads can be produced simultaneously with an improved efficiency. In any event, the thermal head of the present invention can print more clearly since the heating section is located nearer the pressing portion.

Figure 25:
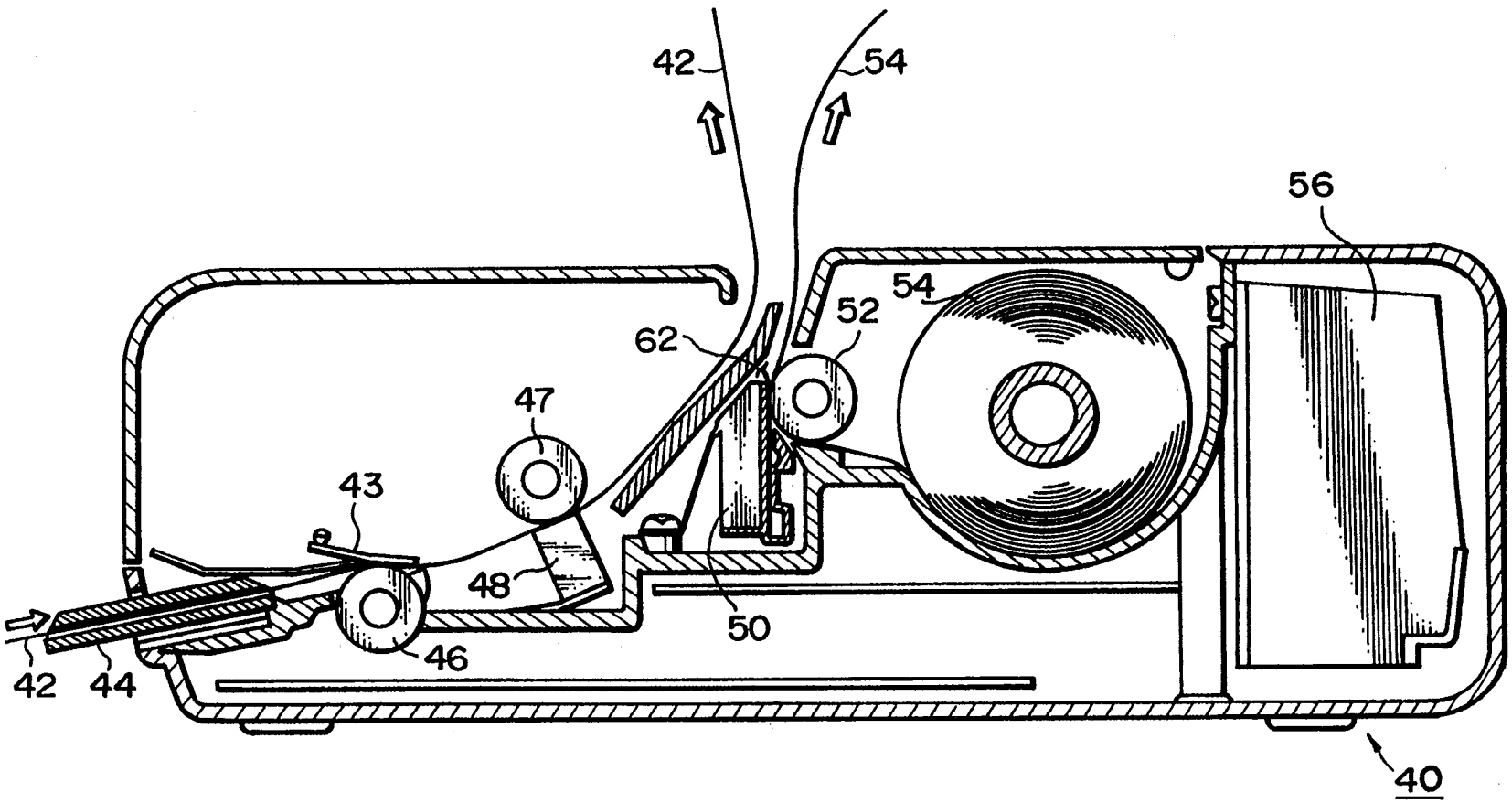
FIG. 25 is a view illustrating an example of a printing system comprising a thermal head constructed in accordance with the present invention.

FIG. 25 shows the arrangement of a printing system 40 including a thermal head which is constructed in accordance with the present invention. The printing system 40 comprises an inlet port 44 for inserting a document 42 into the system, a feed roller 46 for transporting the document to the thermal head, an image sensor 48 for reading the document, a printing section 50 for printing a recording sheet 54 and a recording platen roller 52 located adjacent to the printing section 50. The printing system 40 is actuated by electric energy. As documents 42 are inserted into the printing system 40 through the inlet port 44, they are separated from each other by separator means 43 and transported to the image sensor 48 one at a time. The pattern on the surface of the document 42 is converted into electric signals at the image sensor 48. Based on these electric signals, the recording sheet 54 will be printed at the printing section 50. In order to accommodate the printing on rough paper, the printing system uses an ink ribbon 62. Although the printing system has been described as a copying machine or facsimile including a reading-out mechanism, the thermal head of the present invention may be used in a printer having no reading-out mechanism.

Figure 26A:
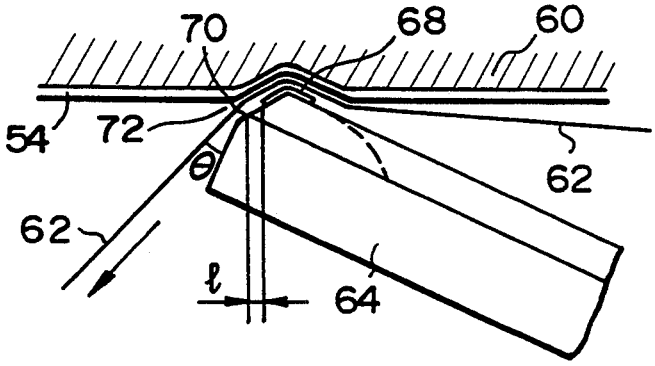
FIG. 26 is a view illustrating the details of the printing mechanism of a printing system which comprises a thermal head constructed in accordance with the present invention.
Figure 26B:
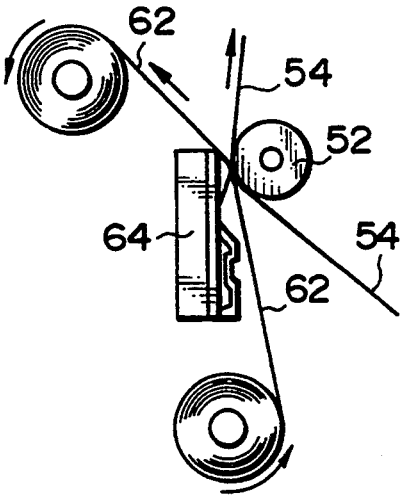
Figure 26C:
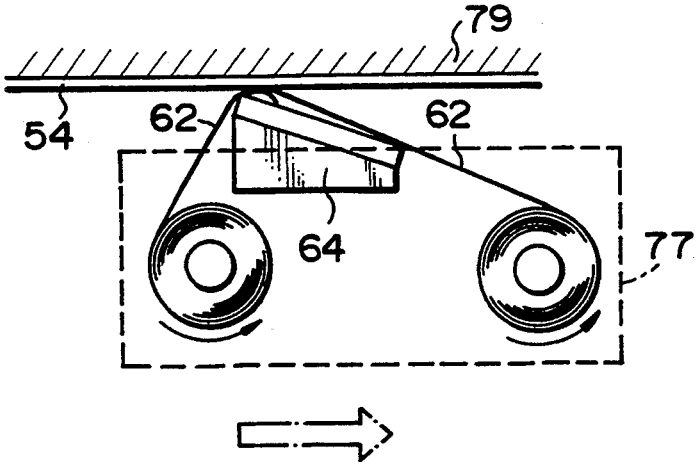
Figure 27:
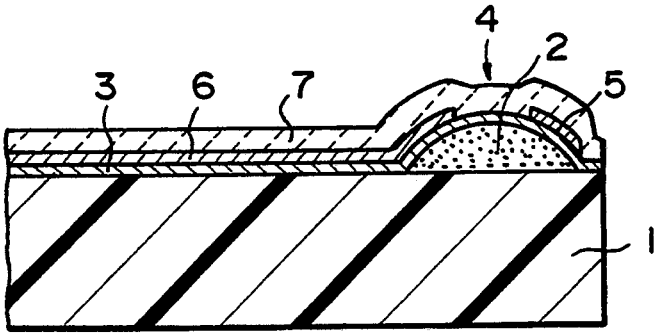
FIG. 27 PRIOR ART
FIG. 27 is an enlarged cross-sectional view of the primary part of a thermal head constructed in accordance with the prior art.
Figure 28:
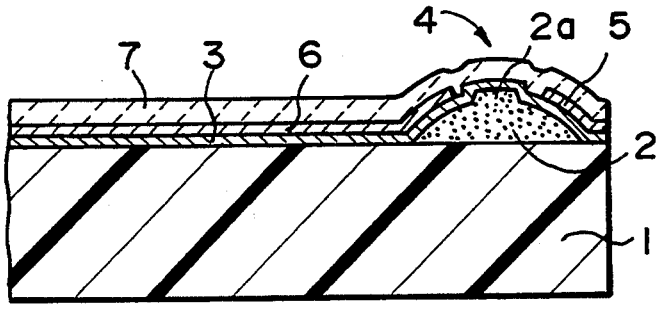
FIG. 28 PRIOR ART
FIG. 28 is an enlarged cross-sectional view of the primary part of a thermal head constructed in accordance with the prior art.
Figure 29:
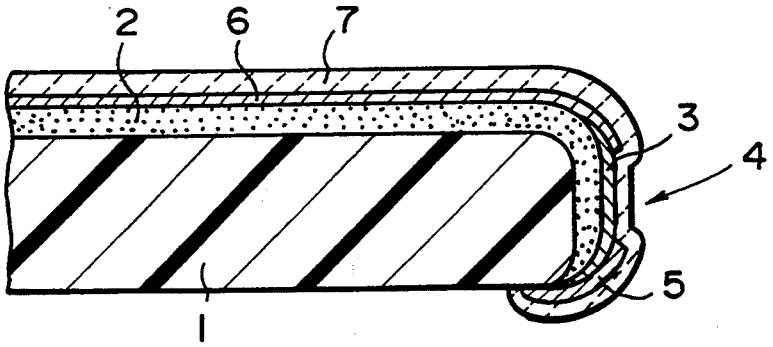
FIG. 29 PRIOR ART
FIG. 29 is an enlarged cross-sectional view of the primary part of a thermal head constructed in accordance with the prior art.
Figure 30:
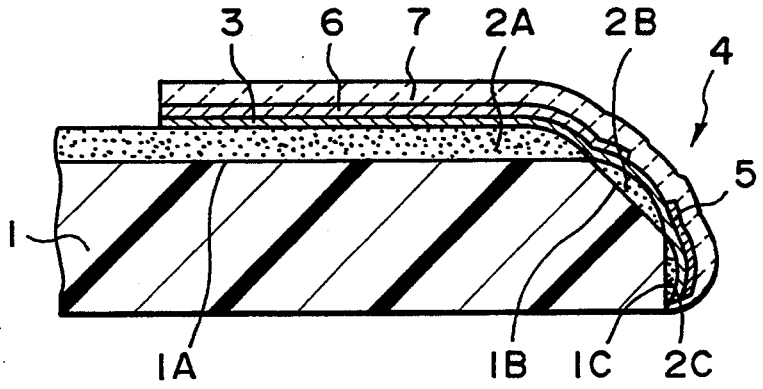
FIG. 30 PRIOR ART
FIG. 30 is an enlarged cross-sectional view of the primary part of a thermal head constructed in accordance with the prior art.
Figure 31:
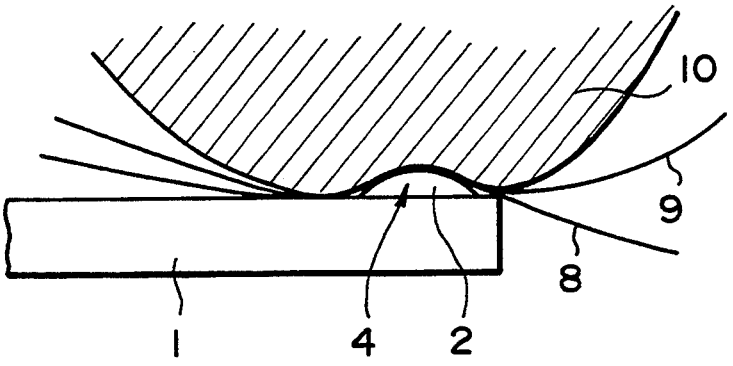
FIG. 31 PRIOR ART
FIG. 31 is a view illustrating the prior art thermal head during its operation.

FIG. 26 shows the details of the printing section 50 shown in FIG. 25. Referring first to FIG. 26(*a*), the recording sheet 54 will run on the rubber platen 60 of the platen roller 52. A thermal head 64 constructed in accordance with any one of the first through ninth embodiments will be pressed against the recording sheet through an ink ribbon 62. The thermal head 64 is diagrammatically illustrated in FIG. 26(*a*). Since the thermal head of the present invention is pressed against the rubber platen 60 adjacent to the corner portion of the thermal head in which a pressing force is increased. Thus, the rubber platen is recessed by the pressing force from the thermal head, at which position the printing will be carried out.

By moving a heating section 68 into the recessed portion of the rubber platen 60, the pattern of a letter is thermally formed while applying the pattern of the letter onto the recording sheet under pressure. A distance L between the heating section 68 and the edge portion 70 of the thermal head is the distance of ribbon separation. If this distance of ribbon separation L is too large, the ink ribbon 62 would be placed in contact with the recording sheet 54 for an elongated time period after the thermal transfer has been completed. This will have cooled the ink ribbon 62 until the recording sheet 54 is separated from the ink ribbon 62 at the point of separation 72. The pattern of the letter transferred from the ink ribbon 62 to the recording sheet 54 will be returned to the ink ribbon 62.

An angle $\theta$ included between the ink ribbon 62 and the thermal head is called an angle of separation. If this angle of separation is too large, the recording sheet 54 will be placed in contact with the ink ribbon 62 for a prolonged time period after the heat transfer as in case when the distance of ribbon separation L is too large. This leads to the same defect in printing as described above. If the thermal head constructed in according to the present invention is used, however, the distance of ribbon separation L can be reduced or nullified and the angle of ribbon separation $\theta$ can also be decreased, as described. Thus, the thermal head of the present invention can produce good, clear printing. FIGS. 26(*b*) is an enlarged view of the primary part of FIG. 25, in which the rubber platen 60 is replaced by the platen roller 52 and the thermal head 64 is held stationary with the recording sheet being transported by roller means. However, the thermal head of the present invention may be applied to a serial printer system in which the thermal head 64 is movable on a flat platen 79 with a ribbon cassette 77 being utilized.

The thermal head of the present invention is economically advantageous in that a number of inexpensive thermal heads can be mass produced. By incorporating a thermal head into a printing system, the latter can be modified into a printing system which is improved in cost and performance to perform the printing economically and clearly.

Although various preferred embodiments of the present invention have been described hereinbefore, the present invention is not limited to such preferred embodiments and may be subjected to various modifications and changes without departing from the true spirit and scope of the invention.

We claim:

1. A thermal head used for printing in a thermal transfer manner by electrically heating a resistive film, said thermal head comprising:

a substrate having a top surface, a side surface and an edge between the top surface and the side surface of said substrate;

a glaze layer formed on the top surface of said substrate, said glaze layer at least partially covering the top surface and extending to the edge of the substrate without covering the side surface of the substrate, said glaze layer having a top glaze portion parallel to the top surface of the substrate, a side glaze portion flush with the side surface of said substrate, and having a corner glaze portion formed at an intersection between said top glaze portion and said side glaze portion; and a heating section sandwiched between two electrodes, said heating section having a resistive film pattern formed on the top, corner, and side glaze portions, said electrodes formed on the resistive film at preselected positions.

2. The thermal head as defined in claim 1, wherein said glaze layer is thermally treated to round said corner glaze portion.

3. The thermal head as defined in claim 2, wherein said heating section is formed on said corner glaze portion of said glaze layer.

4. The thermal head as defined in claim 2, wherein said heating section is formed on said top glaze portion of said glaze layer.

5. The thermal head as defined in claim 2, wherein said heating section is formed on said side glaze portion of said glaze layer.

6. The thermal head as defined in claim 1, wherein said heating section is formed on the corner portion of said glaze layer.

7. The thermal head as defined in claim 1, wherein said heating section is formed on said top glaze portion of said glaze layer.

8. The thermal head as defined in claim 1, wherein said heating section is formed on said side glaze portion of said glaze layer.

9. The thermal head of claim 1, wherein a protective film layer is formed on the resistive film and the electrodes.

10. A thermal head used for printing in a thermal transfer manner by electrically heating a resistive film, said thermal head comprising:

a substrate having a top surface, a side surface and an edge between the top surface and the side surface of said substrate;

a glaze layer formed on the top surface of said substrate, said glaze layer at least partially covering the rod surface and extending to the edge of the substrate without covering the side surface of the substrate, said glaze layer having a top glaze portion parallel to the top surface of the substrate, a side glaze portion flush with the side surface of said substrate, and having a slope glaze portion formed between said top glaze portion and said side glaze portion; and a heating section sandwiched between two electrodes, said heating section having a resistive film pattern formed on the top, slope, and side glaze portions, said electrodes formed on the resistive film at preselected positions.

11. The thermal head as defined in claim 10, wherein said glaze layer is thermally treated to round a boundary between said slope glaze portion and said side glaze portion and a boundary between said slope glaze portion and said top glaze portion.

12. A thermal head as defined in claim 11, wherein said heating section is formed on the slope glaze portion of said glaze layer.

13. The thermal head as defined in claim 11, wherein said heating section is formed on said top glaze portion of said glaze layer.

14. The thermal head as defined in claim 11, wherein said heating section is formed on said side glaze portion of said glaze layer.

15. The thermal head as defined in claim 10 wherein said heating section is formed on the slope glaze portion of said glaze layer.

16. The thermal head as defined in claim 10, wherein said heating section is formed on said top glaze portion of said glaze layer.

17. The thermal head as defined in claim 10, wherein said heating section is formed on said side glaze portion of said glaze layer.

18. The thermal head of claim 10, wherein a protective film layer is formed on the resistive film and the electrodes.

19. A thermal head used for printing in a thermal transfer manner by electrically heating a resistive film, said thermal head comprising:

a substrate having a top surface, a side surface and an edge between the top surface and the side surface of said substrate;

a glaze layer formed on the top surface of said substrate, said glaze layer at least partially covering the top surface and extending to the edge of the substrate without covering the side surface of the substrate, said glaze layer having a top glaze portion parallel to the top surface of the substrate, a side glaze portion flush with the side surface of said substrate, and having a bulged glaze portion formed on said top glaze portion at an intersection between said top glaze portion and said side glaze portion; and a heating section formed on said bulged glaze portion and sandwiched between two electrodes, said heating section having a resistive film pattern formed on the top, bulged, and side glaze portions, said electrodes formed on the resistive film at preselected positions.

20. The thermal head of claim 19, wherein a protective film layer is formed on the resistive film and the electrodes.

21. A printing system comprising an image sensor for reading a document, a thermal head, and a recording platen device for moving a copy sheet passing the thermal head, said thermal head comprising:

a substrate having a top surface, a side surface and an edge between the top surface and the side surface of said substrate;

a glaze layer formed on the top surface of said substrate, said glaze layer at least partially covering the top surface and extending to the edge of the substrate without covering the side surface of the substrate, said glaze layer having a top glaze portion parallel to the top surface of the substrate, a side glaze portion flush with the side surface of said substrate, and having a corner glaze portion formed at an intersection between said top glaze portion and said side glaze portion; and a heating section sandwiched between two electrodes, said heating section having a resistive film pattern formed on the top, corner, and side glaze portions, said electrodes formed on the resistive film at preselected positions.

22. The printing system of claim 21, wherein the corner glaze portion is sloped relative to the top glaze portion and the side glaze portion.

23. The printing system of claim 21, wherein the corner glaze portion has a bulge.

24. The thermal head of claim 21, wherein a protective film layer is formed on the resistive film and the electrodes.

25. A method of producing a thermal head, comprising the steps of:

(a) forming a glaze layer on a top surface of a dielectric substrate, said glaze layer having a top glaze portion;

(b) half-cutting the top surface of the dielectric substrate and the glaze layer to form at least one groove having a side glaze portion and a corner glaze portion;

(c) forming a resistive film layer over said top glaze portion, said corner glaze portion and said side glaze portion;

(d) patterning a heating section by forming a pattern of electrode conductors on said resistive film layer;

(e) forming a protecting film to cover said resistive film layer, electrode conductors and heating section; and (f) cutting down a center of said groove formed at step (b) to provide a plurality of thermal heads.

26. The method of producing a thermal head as defined in claim 25, wherein said groove has a substantially rectangular cross-section.

27. The method of producing a thermal head as defined in claim 26, said method further comprising after the half-cutting step, the step of thermally treating the corner portion to round said corner portion.

28. The method of producing a thermal head as defined in claim 25, wherein said groove has a substantially trapezoidal cross-section to form the corner portion as a sloped edge.

29. The method of producing a thermal head as defined in claim 28, said method further comprising after the half-cutting step, the step of thermally treating the boundary between the sloped edge and the top glaze portion.

30. The method of producing a thermal head as defined in claim 25, wherein said groove has a substantially rectangular cross-section and further comprising after step (b), a step of performing a heat treatment to form a bulged portion on said corner portion.

31. A method of producing a thermal head, comprising the steps of:

(a) forming a glaze layer on a top surface of a substrate, said glaze layer having a top glaze portion;

(b) half-cutting the top surface of the substrate and the glaze layer to form at least one groove having a side glaze portion and a slope glaze portion, said at least one groove having a trapezoidal cross-section to form the slope glaze portion as a sloped edge;

(c) forming a resistive film layer over said top glaze portion, said slope glaze portion and said side glaze portion;

(d) patterning a heating section by forming a pattern of electrode conductors on said resistive film layer;

(e) forming a protecting film to cover said resistive film layer, electrode conductors and heating section; and (f) cutting down a center of said groove formed at step (b) to provide a plurality of thermal heads.

32. The method of producing a thermal head as defined in claim 31, said method further comprising after the half-cutting step, the step of thermally treating the boundary between the slope glaze portion and the top glaze portion.

33. A method of producing a thermal head, comprising the steps of:

(a) forming a glaze layer on a top surface of a substrate, said glaze layer having a top glaze portion;

(b) half-cutting the top surface of the substrate and the glaze layer to form at least one groove having a side glaze portion and a corner glaze portion, said at least one groove having a rectangular cross-section;

(c) performing a heat treatment to form a bulged portion on said corner portion;

(d) forming a resistive film layer over said top glaze portion, said corner glaze portion and said side glaze portion;

(e) patterning a heating section by forming a pattern of electrode conductors on said resistive film layer;

(f) forming a protecting film to cover said resistive film layer, electrode conductors and heating section; and (g) cutting down a center of said groove formed at step (b) to provide a plurality of thermal heads.

* * * * *